US007946297B1

(12) United States Patent
Fernandez

(10) Patent No.: US 7,946,297 B1
(45) Date of Patent: May 24, 2011

(54) HAIR EXTENSION HOLDER

(76) Inventor: Mario Fernandez, Edina, MN (US)

( * ) Notice: Subject to any disclaimer, the term of this patent is extended or adjusted under 35 U.S.C. 154(b) by 507 days.

(21) Appl. No.: 12/022,857

(22) Filed: Jan. 30, 2008

Related U.S. Application Data

(60) Provisional application No. 60/887,303, filed on Jan. 30, 2007.

(51) Int. Cl.
*A41G 3/00* (2006.01)

(52) U.S. Cl. ..... 132/201; 132/53

(58) Field of Classification Search ..... 132/201, 132/53–56, 105, 273, 275, 278; D28/92
See application file for complete search history.

(56) References Cited

U.S. PATENT DOCUMENTS

| | | | | |
|---|---|---|---|---|
| 5,303,724 | A * | 4/1994 | Anzivino | 132/278 |
| 5,396,912 | A * | 3/1995 | Chou | 132/279 |
| 2005/0103358 | A1* | 5/2005 | Sanders | 132/201 |
| 2006/0162738 | A1* | 7/2006 | Chudzik et al. | 132/278 |

* cited by examiner

*Primary Examiner* — Rachel R Steitz
(74) *Attorney, Agent, or Firm* — Dicke, Billig & Czaja, PLLC

(57) ABSTRACT

A hair extension holder including a main body and a cover. The main body has a recess formed therein that is adapted to receive a hair extension bundle. The cover is operably attached to the main body such that the cover is movable with respect to the main body. A recess is defined between the cover and the main body that is adapted to receive a plurality of hairs.

8 Claims, 2 Drawing Sheets

HAIR EXTENSION HOLDER

REFERENCE TO RELATED APPLICATION

This application claims priority to U.S. Provisional Application No. 60/887,303, filed on Jan. 30, 2007, the contents of which are incorporated herein by reference.

FIELD OF THE INVENTION

The invention relates generally to a system of attaching hair extensions. More particularly, the invention relates to a method of removably attaching hair extensions using a hair extension holder.

BACKGROUND OF THE INVENTION

When a person perceives that his or her hair does not have desired characteristics such as length, it is possible for the person to obtain hair extensions. The hair extensions are typically attached to the person's natural hair and thereby enhance the overall appearance of the person's natural hair.

Diaz, U.S. Pat. No. D447,286, discloses a hair extension having a loop at an end for attaching to the person's natural hair. Diaz, U.S. Pat. No. D433,774, describes a hair extension having two extension ends that are interconnected with a connection portion that is attached to the person's hair. Lee, U.S. Pat. No. 6,962,157, teaches a hair extension that includes a comb for attaching the extension to the person's natural hair.

Because the person's natural hair grows, it is necessary to persons who have hair extensions to periodically have the hair extensions repositioned. Depending on the attachment method used and the number of hair extensions used, the process of repositioning the hair extensions can be quite time consuming.

SUMMARY OF THE INVENTION

The invention relates to a hair extension holder that is used for attaching a hair extension to a person's natural hair. The hair extension holder has a recess formed therein where the extension hair is attached. The hair extension holder also has a channel extending therethrough through which the person's natural hair extends.

The hair extension holder is positionable in an open position and a closed position. When the hair extension holder is in the open position, the hair extension holder is movable with respect to the person's natural hair to position the hair extension holder in a desired location. When the hair extension holder is in the closed position, the hair extension holder is retained in a fixed position with respect to the person's natural hair.

DETAILED DESCRIPTION OF THE PREFERRED EMBODIMENTS

Figure 1:
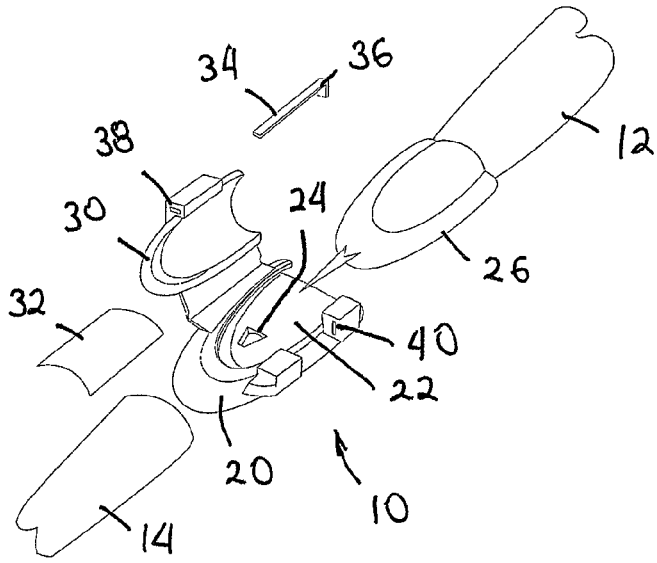
FIG. 1 is an exploded perspective view of a hair extension holder according to an embodiment of the invention.
Figure 2:
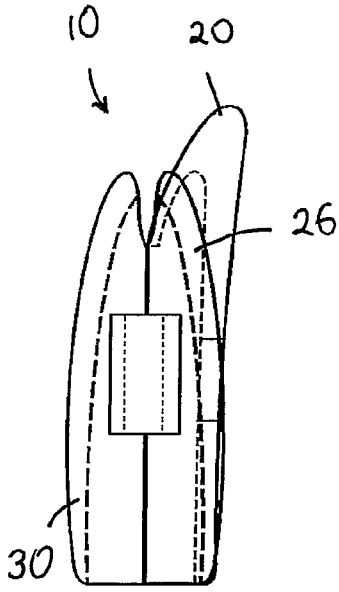
FIG. 2 is a first side view of the hair extension holder.
Figure 3:
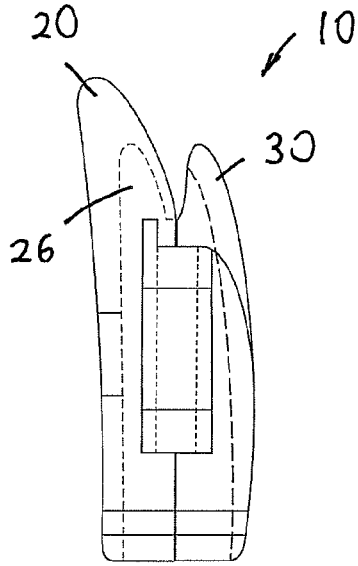
FIG. 3 is a second side view of the hair extension holder.
Figure 4:
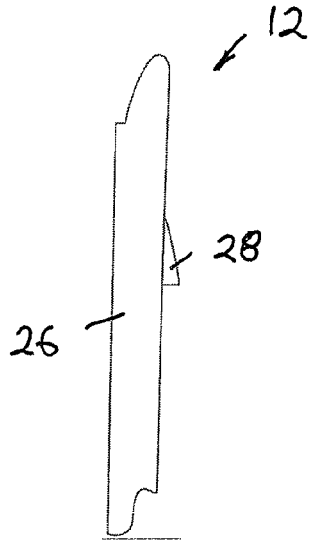
FIG. 4 is a side view of a hair pack for use in the hair extension holder.
Figure 5:
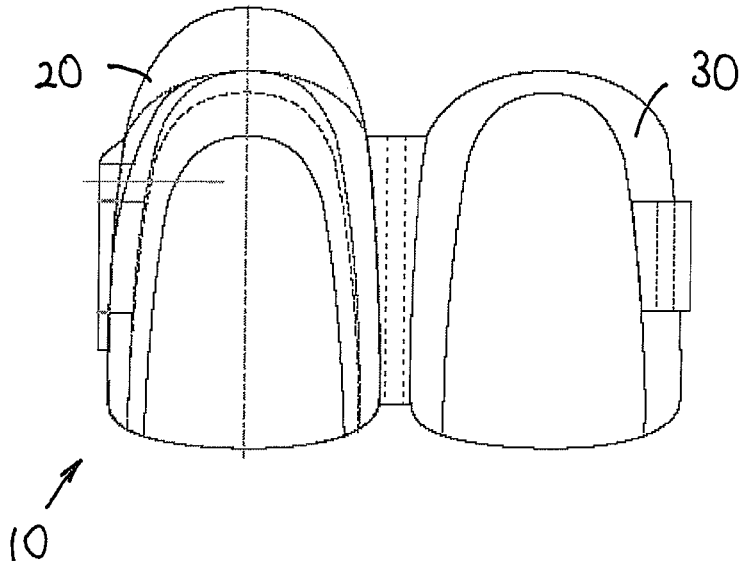
FIG. 5 is a top view of the hair extension holder in an open configuration.

The invention is a hair extension holder, as illustrated at 10 in the Figures. The hair extension holder 10 enables a hair extension 12 to be readily attached with respect to a person's natural hair 14. The hair extension holder 10 also enables the hair extension 12 to be readily repositioned with respect to the natural hair 14 such as when the natural hair 14 grows.

The hair extension holder 10 of the present invention enables the hair extension 12 to be initially positioned and then repositioned with minimal tools and in certain circumstances using a person's fingernail. The hair extension holder 10 thereby enables the hair extension 12 to be attached to and detached from the person's natural hair 14 without the use of chemicals, waxes or other attachment device that damage either the person's natural hair or the person's scalp.

The hair extension holder 10 may have a relatively small size to reduce the potential of the hair extension holder 10 being seen when it is attached to the natural hair 14. The hair extension holder 10 may have a length of less than about 1 inch, preferably less than about 0.5 inches and more preferably about 0.244 inches. The hair extension holder 10 may have a width of less than about 1 inch, preferably less than about 0.5 inches and more preferably about 0.125 inches. The hair extension holder 10 may have a height of less than about 1 inch, preferably less than about 0.5 inches and more preferably about 0.066 inches.

The hair extension holder 10 may be fabricated from a variety of material. In one configuration, the hair extension holder 10 is fabricated from injection molded plastic.

To further reduce the ability to see the hair extension holder 10 when attached to the natural hair, the hair extension holder 10 may be fabricated with a color that is either identical to or similar to the hair extension 12. Alternatively, the hair extension holder 10 may be fabricated with colors that attract attention thereto such that wearing the hair extension 12 and associated hair extension holder 10 could make a fashion statement.

The hair extension holder 10 generally includes a main body 20 with a recess 22 formed therein. The recess 22 is adapted to receive the hair extension 12. An indention or aperture 24 may be provided in the recess 22 to enhance the ability to retain the hair extension 12 at a fixed location with respect to the hair extension holder 10.

It is desirable for the hair extension 12 to be positioned as close as possible to the natural hair 14 to enhance realistic appearance of the hair extension 12. To enhance the ability to retain the hair extension 12 in the recess 22, the main body 20 may extend at least partially over the end of the hair extension 12. In one configuration, the main body extends over both sides as well as an end of the hair extension 12.

Alternatively or in addition, the hair extension 12 may be attached to the hair extension holder 10 using an adhesive or a mechanical fastener. The attachment of the hair extension 12 to the hair extension holder 10 may be permanent or removable.

The hair extension 12 may be formed from a plurality of natural hairs, synthetic hair or combination thereof. The number of hairs in the hair extension 12 are selected based upon the desired application and may include in excess of 100 hairs.

The hair extension 12 may include an end cap 26 that is attached to a bundle of hair strands 27. The end cap 26 may have a shape that generally conforms to a shape of the recess 22. The cap 26 facilitates attachment of the hair extension 12 to the hair extension holder 10. In one configuration, the end cap 26 includes a tab 28 extending from a lower surface thereof. The tab 28 seats in the aperture 24 to enhance the ability to retain the hair extension 12 in a fixed position with respect to the hair extension holder 10.

Figure 6:
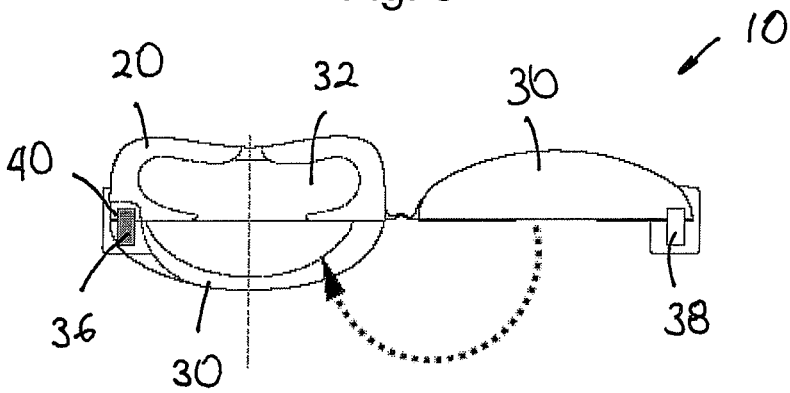
FIG. 6 is a top view of the hair extension holder in open and closed configurations.
Figure 7:
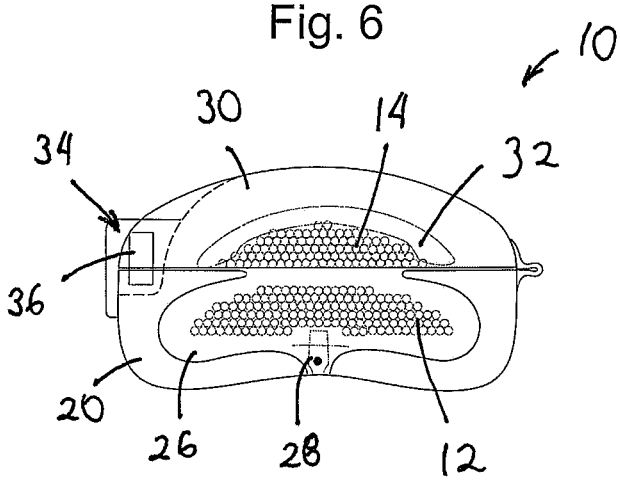
FIG. 7 is a sectional view of the hair extension holder taken along a line 7-7 in FIG. 5.

The hair extension holder 10 also includes a cover 30 that is operably attached to the main body 20. The cover 30 may be movably attached to the main body 20 to facilitate moving the cover 30 between an open position and a closed position, as illustrated in FIG. 6. In one configuration, the cover 30 is pivotally mounted to the main body 20.

When the cover 30 is in the open position, there is a separation between the main body 20 and the cover 30 to facilitate passing the natural hair 14 therethrough. When the cover 30 is in the closed position, the cover 30 is adjacent the main body 20 so that the natural hair 14 is restricted from moving with respect to the hair extension holder 10.

In one configuration, the space between the cover 30 and the main body 20 facilitates placing approximately 100 natural hairs 14 therein. The bundle of natural hair 14 should fit snuggly in the space but not require a relatively large force to move the cover 30 to the closed position with respect to the main body 20.

To further enhance the ability to retain the hair extension holder 10 in a stationary position with respect to the natural hair 14, a friction enhancing layer 32 may be placed between the natural hair 14 and at least one of the cover 30 and the main body 20. In one configuration, the friction enhancing layer 32 is a relatively thin piece of neoprene.

Because of the relatively small size of the friction enhancing layer 32, the friction enhancing layer 32 may be attached to the cover 30 or the main body 20 using an adhesive or other mechanism.

The cover 30 may be retained in a closed position with respect to the main body 20 using a locking mechanism 34. In one configuration, the locking mechanism 34 is a locking pin 36 that extends through a first locking aperture 38 in the cover 30 and a second locking aperture 40 in the main body 20. It is also possible to utilize alternate locking mechanisms 34 to retain the cover 30 in the closed configuration, examples of which include snaps and friction fit.

In operation, the cover 30 is moved to an open position with respect to the main body 20. A group of the person's natural hair 14 is positioned between the cover 30 and the main body 20 so that the hair extension holder 10 is in a desired position with respect to the person's scalp.

The cover 30 is then move to the closed position to retain the hair extension 12 and the associated hair extension holder 10 in a fixed position with respect to the person's natural hair 14.

When it is desired to remove or reposition the hair extension 12, the cover 30 is moved to the open position with respect to the main body 20 so that the natural hair 14 is movable with respect to the hair extension holder 10. Moving the cover 30 with respect to the main body 20 can be done either with a small tool or a fingernail.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A hair extension system comprising:

a hair extension bundle comprising a plurality of hair strands and an end cap attached thereto, wherein a tab extends from a surface of the cap; and a hair extension holder comprising:

a main body having a recess formed therein that is adapted to receive the end cap, wherein the main body has an aperture formed therein and wherein the tab is adapted to at least partially seat in the aperture to retain the hair extension bundle in a stationary position with respect to the hair extension holder;

a cover operably attached to the main body such that the cover is movable with respect to the main body, wherein a region is defined between the cover and the main body that is adapted to receive a plurality of the user's hairs; and a locking mechanism to maintain the cover in a closed position with respect to the main body.

2. The hair extension system of claim 1, wherein the cover is pivotally attached to the main body.

3. The hair extension system of claim 1, wherein the cover has a first locking aperture, wherein the main body has a second locking aperture, and wherein the locking mechanism comprises a locking pin that is positionable at least partially in the first locking aperture and the second locking aperture.

4. The hair extension system of claim 1, and further comprising a slip resistant material attached to at least one of the main body and the cover.

5. A method of attaching hair extension comprising:

providing a hair extension holder comprising a main body and a cover, wherein the main body has a recess formed therein, wherein the main body has an aperture formed therein;

providing a hair extension bundle comprising a plurality of hair strands and an end cap attached thereto, wherein a tab extends from a surface of the cap;

attaching a hair extension bundle to the main body at least partially in the recess;

restricting movement of the hair extension bundle with respect to the hair extension holder by at least partially seating the tab in the aperture;

positioning a plurality of the user's hairs between the main body and the cover;

moving the cover to a closed position with respect to the main body to retain the hair extension bundle in a fixed position with respect to the plurality of hairs; and locking the cover in the closed position with a locking mechanism.

6. The method of claim 5, wherein moving the cover with respect to the main body comprises pivoting the cover.

7. The method of claim 5, wherein the cover has a first locking aperture, wherein the main body has a second locking aperture, wherein the locking mechanism comprises a locking pin and further comprising at least partially extending the locking pin in the first locking aperture and the second locking aperture.

8. The method of claim 5, and further comprising restricting movement of the plurality of hairs with respect to the hair extension holder with a slip resistant material attached to at least one of the main body and the cover.

* * * * *